US005675853A

United States Patent [19]

Linge

[11] Patent Number: 5,675,853

[45] Date of Patent: Oct. 14, 1997

[54] INFANT SEAT CUSHION

[76] Inventor: Danny L. Linge, 8706 N.E. 18th Ave., Vancouver, Wash. 98665

[21] Appl. No.: 742,211

[22] Filed: Oct. 31, 1996

Related U.S. Application Data

[60] Provisional application No. 60/006,916 Nov. 17, 1995.

[51] Int. Cl. [6] ..... A47C 20/00

[52] U.S. Cl. ..... 5/655; 5/417; 5/630; 5/922

[58] Field of Search ..... 5/655, 603, 922, 5/636, 637, 638, 639, 417, 419, 420, 630, 631, 632, 657, 653

[56] References Cited

U.S. PATENT DOCUMENTS

| | | | |
|---|---|---|---|
| D. 229,639 | 12/1973 | Woog . | |
| D. 328,683 | 8/1992 | Kalozdi . | |
| D. 333,752 | 3/1993 | Mason . | |
| D. 342,855 | 1/1994 | Butler . | |
| 3,269,621 | 8/1966 | Dishart | 5/655 |
| 3,271,028 | 9/1966 | Albin . | |
| 3,729,752 | 5/1973 | Huggins | 5/655 |
| 4,068,786 | 1/1978 | Taniguchi | 5/419 |
| 4,441,221 | 4/1984 | Enste et al. . | |
| 4,566,449 | 1/1986 | Smith . | |
| 4,911,105 | 3/1990 | Hocum | 5/630 |
| 5,165,130 | 11/1992 | Wendling . | |
| 5,172,440 | 12/1992 | Ming . | |
| 5,261,134 | 11/1993 | Matthews . | |
| 5,339,472 | 8/1994 | Yin . | |
| 5,357,642 | 10/1994 | Clute | 5/655 |
| 5,392,477 | 2/1995 | Wolter et al. . | |
| 5,439,008 | 8/1995 | Bowman . | |
| 5,440,770 | 8/1995 | Nichols | 5/603 |
| 5,551,108 | 9/1996 | Butler | 5/655 |

FOREIGN PATENT DOCUMENTS

| | | | |
|---|---|---|---|
| 2507454 | 12/1982 | France | 5/420 |

*Primary Examiner*—Flemming Saether
*Attorney, Agent, or Firm*—Richard C. Litman

[57] ABSTRACT

An infant support cushion provides a safe support for an infant which is beginning to develop muscular strength and motor coordination, particularly in the cervical muscles. An infant using the present cushion is protected in the event the infant lifts his/her head and drops the head uncontrollably to the underlying surface. The cushion comprises a generally rectangular resilient cushion portion of foam or other suitable material, having a generally central depression extending across the majority of the cushion. The depression is adapted to accept the torso of an infant placed therein, in either a prone or supine position, with the thicker cushion material extending across the closed end of the depression serving to cushion the head of an infant if the infant drops his/her head. The cushion may include storage space therein, as well as a removable and washable cover, a restraint for the infant, and a removable and washable drool bib which may be secured beneath the infant's head. A removable, washable blanket for the legs and lower torso of the infant and a removable and washable changing pad may also be provided with the cushion, with the blanket and changing pad being securable to the underside of the cushion for storage. The present cushion not only provides a safe environment from which an infant beginning to develop motor skills may observe the environment, but also provides a safe and comfortable place for the infant to sleep.

20 Claims, 3 Drawing Sheets

INFANT SEAT CUSHION

REFERENCE TO RELATED PATENT APPLICATION

This application is based upon U.S. provisional patent application Ser. No. 60/006,916, filed on Nov. 17, 1995.

BACKGROUND OF THE INVENTION

1. Field of the Invention

The present invention relates generally to cushions, pads, and the like, and more specifically to an infant support cushion including a generally central depression adapted to hold an infant therein. The cushion provides partial support as the infant is learning basic motor skills, such as raising the head, and protects the infant from injury in the event the infant allows the head to drop. Other accessories, such as storage means, a changing pad, and/or a blanket, may be provided with the cushion, as desired.

2. Description of the Prior Art

The initial development of motor skills and muscular strength in very young infants is recognized to be a difficult and potentially hazardous period for them. As infants develop, they learn to raise their heads to observe the environment, and react to the stimuli that surround them. However, the effort involved in raising their heads is tiring, due to the lack of muscular strength in very young infants.

This can often result in the infant's head falling, rather than being lowered, to the underlying surface, particularly when the lack of motor skills of such an infant is considered. Accordingly, many parents and guardians have attempted to provide various padding, cushioning, or other protection for infants at this stage of development, but most such efforts have not met with appreciable success. As an example, parents will often place an infant on a pillow resting on the floor, but the contours of the pillow allow an infant to roll to one side or the other, and off the pillow. Blankets provide only limited protection, particularly on a hard floor, unless a great number are used, which solution is generally unworkable.

Accordingly, a need will be seen for an infant support cushion which is adapted to nest the infant in a prone or supine position in a channel or depression generally centered therein, to prevent the infant from rolling to either side. The central depression extends only partially across the cushion, with a thicker end area providing cushioning for the head of an infant placed on the cushion. Other accessories may be provided as well, such as a removable and washable cover, a removable and washable bib or drool cloth, a removably attachable changing pad and blanket, a harness to prevent the infant from slipping from the channel or depression, and/or storage means within the cushion. A discussion of the prior art of which the present inventor is aware, and its distinctions from the present invention, is provided below.

U.S. Pat. No. 3,271,028 issued on Sep. 6, 1966 to Alvina K. Albin describes a Baby Exerciser comprising a raised central portion with lateral handles to each side. The central portion and handles are relatively hard, but only the raised central portion is provided with any padding. A chest harness is provided, but this does nothing to prevent the child from sliding backwards from the device. No cushioning or support is provided for the head of the child, and the convex shape of the device is not suitable for the placement of a child therein in a supine position. No storage means or additional blanket or padding is disclosed by Albin.

U.S. Pat. No. 4,441,221 issued on Apr. 10, 1984 to Klemens Enste et al. describes a Child Support Wedge comprising a plurality of interchangeable foam blocks of solid geometric shapes. Enste et al. note that the various blocks may be covered with "artificial leather" (col. 2, line 51), but no mention is made of the removability of the covering from the foam. Any central, body hugging depression must be built up of a plurality of the blocks, whereas the present invention is adapted only to very small infants and is formed of a single, unitary piece of material. Enste et al. make no mention of any storage space, changing pad, or additional blanket with their device, and any head protection must be built up from one or more components, unlike the unitary construction of the present infant support cushion. The Enste et al. device is not well adapted to hold infants in a prone position, as no head support or cushioning is provided.

U.S. Pat. No. 4,566,449 issued on Jan. 28, 1986 to Jan E. Smith describes an Elevated Infant Positioner, which is adapted to assist in the prevention of gastroesophageal reflux (regurgitation) in premature infants. Accordingly, the device is adapted to support an infant placed therein at approximately a 30 degree angle to the horizontal, with the head raised. The device does have a much higher and thicker cushion beneath the head of an infant placed therein, but it is exceedingly bulky and is not well adapted for compact storage or for use with normal postnatal infants having normal gestation periods. While Smith mentions the use of straps to secure an infant to the device, no specific strap configuration is disclosed. Moreover, Smith is silent regarding removable and washable covers, pads, blankets, and/or any storage incorporated therewith.

U.S. Pat. No. 5,165,130 issued on Nov. 24, 1992 to Helen L. Wendling describes a Multipositional Infant Support System, comprising a blanket or the like and a pair of elongate rectangular cushions which are adjustably attachable to the blanket in a variety of configurations. With two adjacent cushion ends secured together to form a V pattern for the cushions, an infant may be nested in the V and provided with some upper body support. However, the configuration does not conform to the shape of the infant's body, and the only head support is provided by intersection of the corners of the two cushions, unlike conforming shape and wider support provided by the present invention. No changing pad or storage means is disclosed by Wendling.

U.S. Pat. No. 5,172,440 issued on Dec. 2, 1992 to Wu L. Ming describes a Quilt Bag, comprising a decorative cover which is sewn to a quilt, blanket, or sleeping bag for the containment thereof. The cover is unzipped and the attached blanket, etc. is folded into the open cover, whereupon the cover is zipped closed to provide an attractive enclosure for the contained blanket or other article. Ming fails to provide any form of support for an infant or other person, as the device is purely a cover or container for a foldable article, which is sewn to the article.

U.S. Pat. No. 5,261,134 issued to Susan H. Matthews on Nov. 16, 1993 describes an Infant Support Pillow in a generally C-shaped configuration. The arms adjacent the open side of the C are tapered to a smaller diameter than the central portion of the cushion. An infant may be nestled in the center opening of the cushion for support. No underlying cushion area is provided, and thus the body of the infant would be resting upon the underlying surface, rather than being supported by a central portion of the cushion. Matthews does not disclose any removable cover means, changing pad, removable blanket, or storage means for her cushion.

U.S. Pat. No. 5,339,472 issued to Helen Yin on Aug. 23, 1994 describes an Infant Head And Neck Support Pillow, comprising a rectangular cushion having an open side communicating with a central opening. The result is similar to the Matthews cushion discussed above, except that the Yin cushion has a rectangular periphery. No support is provided for the head of an infant using the cushion, other than to keep the head from dropping to the side.

U.S. Pat. No. 5,392,477 issued on Feb. 28, 1995 to Jon Wolter et al. describes a Sleeping Bag With Inflatable Wedge Portion, comprising a foam mat with a wedge shaped inflatable headrest area. Storage compartments are disclosed at the foot of the assembly. No central channel or depression is disclosed which would prevent a user from rolling to one side or the other, and no restraint or changing pad is disclosed, as the apparatus is not adapted or intended for use by infants.

U.S. Pat. No. 5,439,008 issued on Aug. 8, 1995 to Karolen C. Bowman describes an Infant Reflux Restraint Apparatus, comprising a wedge shaped cushion with adjustably attachable pads, straps, and supports. The purpose of the device is the same as that of the Smith '449 patent discussed further above, i.e., to reduce or prevent gastroesophageal reflux in an infant resting thereon. The device differs from the present invention in that (1) it is wedge shaped, rather than having a generally flat upper surface; (2) the lateral support for an infant therein is formed adjustably securing pads to the wedge shaped cushion, rather than providing a cushion with a depression formed integrally therein for the torso of the infant; and (3) providing a separately attachable head rest cushion, unlike the present invention. Moreover, Bowman does not disclose a separately attachable blanket, changing pad, storage area for her cushion, each of which may be provided with the present invention.

U.S. Pat. No. D-229,639 issued on Dec. 18, 1973 to James N. Woog illustrates a design for a Patient Positioning Cushion comprising a generally T-shaped cushion atop a pad having a slightly tapered thickness. The stem of the T of the cushion is split, with various straps adjacent the base of the stem. It appears that the central channel along the stem of the T would not be sufficiently wide to accommodate the torso of an infant or other person, and the underlying pad is relatively thin compared to the thickness of the present cushion. No storage area or attachable blanket or changing pad are disclosed U.S. Pat. No. D-328,683 issued on Aug. 18, 1992 to Monica E. Kalozdi illustrates a design for a Pillow Assembly For Babies Or The Like, comprising a thin rectangular sheet with a generally horseshoe shaped collar or pad secured thereto. As in the Woog design patent discussed above, the sheet to which the collar is secured is relatively thin, and appears to provide little, if any, padding in comparison to the cushion of the present invention. No removable cover, blanket, changing pad, or storage area, is apparent in the Kalozdi design.

U.S. Pat. No. D-333,752 issued on Mar. 9, 1993 to Cynthia A. Mason illustrates a design for an Infant Support Pad, having an L-shaped configuration with a central depression closely conforming to the body of an infant. The curvature of the pad renders it unsuitable for holding an infant in a prone position, as provided by the present cushion. No removable cover, storage space, changing pad, or blanket is apparent in the Mason design.

Finally, U.S. Pat. No. D-342,855 issued on Jan. 4, 1994 to George D. Butler, II illustrates a design for a Combined Infant Cushion And Cover, comprising a rectangular cushion with a generally U-shaped depression centrally located therein. A blanket is also shown which folds upwardly from the foot of the cushion, to cover the majority of the cushion. No restraining means, storage area, or changing pad is apparent in the Butler, II disclosure.

None of the above inventions and patents, taken either singly or in combination, is seen to describe the instant invention as claimed.

SUMMARY OF THE INVENTION

Accordingly, it is a principal object of the invention to provide an improved infant support cushion serving to protect an infant secured therein, from head injury as the infant develops muscular strength and motor coordination in the neck.

It is another object of the invention to provide an improved infant support cushion comprising a generally rectangular shape with an elongate central depression extending partially thereacross and adapted to accept the torso of an infant therein, with the portion of the cushion extending across the closed end of the depression serving to cushion the head of an infant supported in the cushion.

It is a further object of the invention to provide an improved infant support cushion which may include a removable and washable cover therefore, a removable and washable protective drool bib disposed beneath the head of an infant supported within the cushion, restraining means for an infant supported in the cushion, storage means disposed within the cushion, and/or a removable and washable blanket and changing pad for the cushion.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
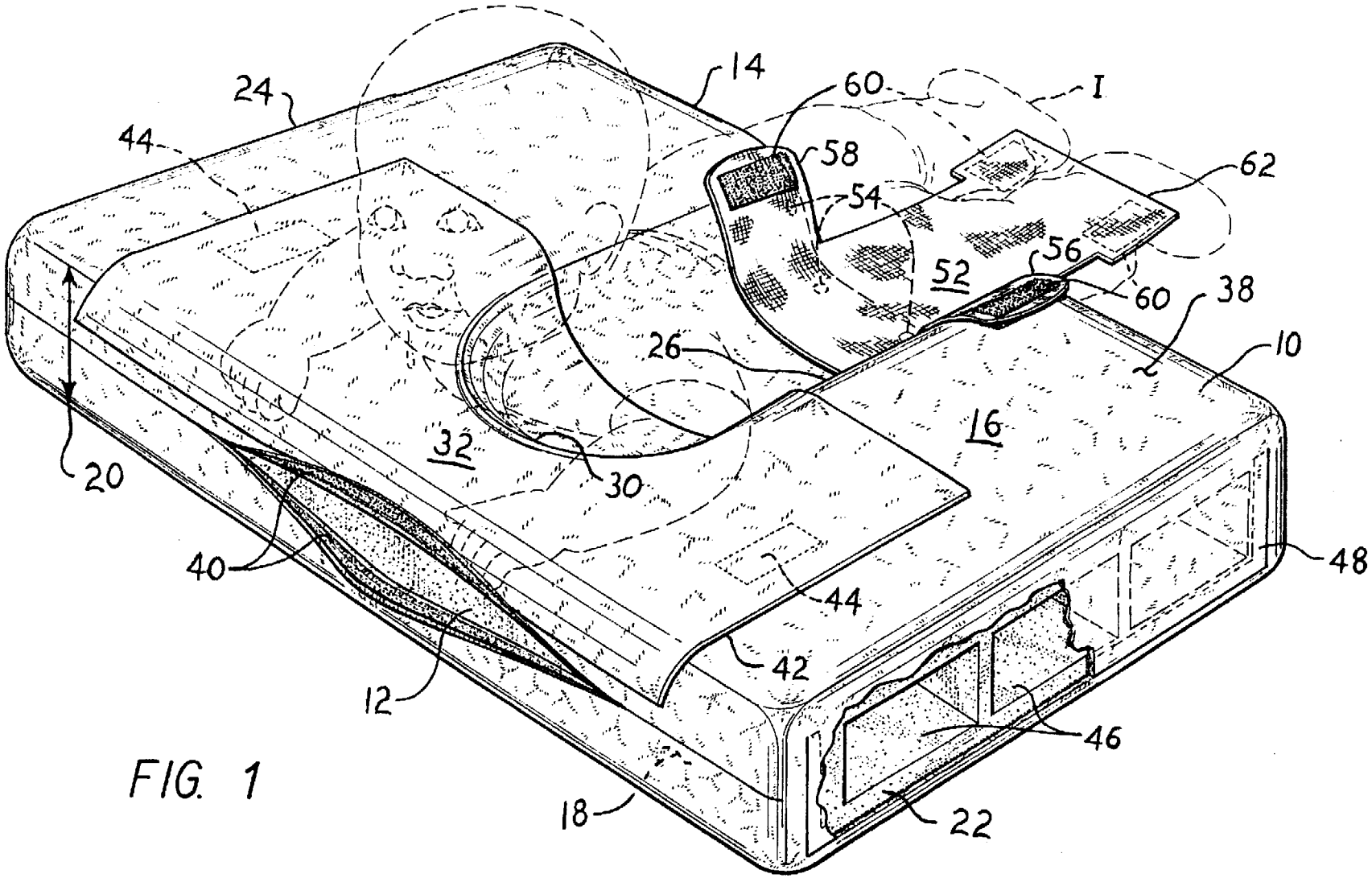
FIG. 1 is a perspective view of the present infant support cushion showing details thereof, with a portion of the cushion cover broken away to show further detail.

The present invention comprises an infant support cushion, indicated generally by the reference numeral 10 in the accompanying drawing figures. The cushion 10 is preferably formed of a single, unitary piece of resilient material, such as an open cell foam plastic material, or other suitable material (e.g., closed cell foam) as desired. The cushion 10 is preferably in the form of a rectangular parallelepiped configuration, with a forward edge or face 12, an opposite rearward edge or face 14, an upper surface 16, an opposite lower surface 18 parallel to the upper surface 16 and defining a cushion depth 20 therebetween, a first end 22, and a second end 24 opposite the first end 22.

A generally semicylindrical infant torso cradling depression 26 is formed generally centrally in the upper surface 16 of the cushion 10. The depression 26 has an open first or rearward end 28 (FIGS. 2 and 3), terminating at the rearward edge or face 14 of the cushion 10, and an opposite smoothly rounded and closed second or forward end 30, which terminates short of the forward edge or face 12 of the cushion 10 to define an infant head supporting and protecting portion 32 disposed between the forward end 30 of the depression 26 and the forward edge or face 12 of the cushion 10.

Figure 3:
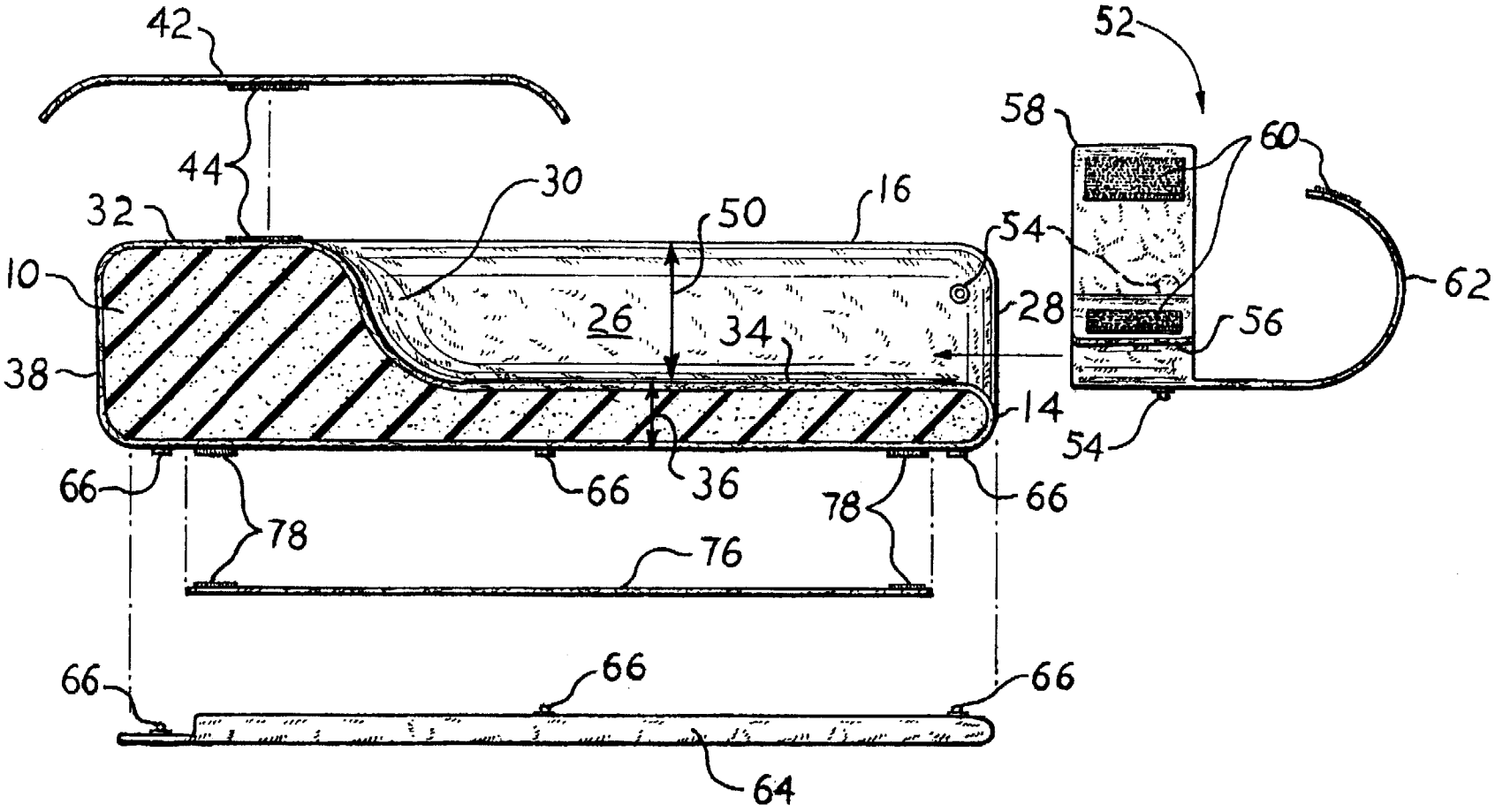
FIG. 3 is an exploded side elevation view in section of the cushion of FIG. 2, showing the relationship of the components.

The depression 26 includes a central, lowermost portion 34, which defines a minimum thickness 36 between the lower surface 18 of the cushion 10 and the lowermost portion 34 of the depression 26, as shown in FIG. 3. This thickness 36 is still substantial, to provide adequate comfort for an infant I using the cushion 10.

FIG. 3 also shows that the infant cradling depression 26 has a depth 50 which preferably extends downwardly from the upper surface 16 of the cushion 10, somewhat more than half the total thickness 20 of the cushion 10. This provides a relatively deep depression 26, sufficient to cradle a very young infant I therein with no danger that the infant I will be able to roll upwardly and out of the depression 26 to either side.

A removable, washable, form fitting cover 38 is preferably provided with the cushion 10. The cover 38 may be formed of fabric or other suitable material, and is preferably treated to reduce or eliminate spills, etc. from passing therethrough to soil the underlying cushion. The cover 38 may be secured about the cushion 10 by means of an opening along the forward face thereof (corresponding to the forward face 12 of the cushion 10), or other opening or seam located as desired, and may be selectively closed by means of mating portions of hook and loop fastening material 40 (e.g., Velcro, tm) along the opening.

Further protection may be provided by a removable and washable drool bib 42, which is adapted to be removably secured over the second end 30 of the depression 26 and the head protection and support area 32 of the cushion 10, where the head and face of an infant I are positioned when the infant I is cradled within the depression 26. The drool bib 42 provides further protection for the cushion 10 and the cover 38, and is preferably held in place by plural patches of hook and loop fastening material 44. The bib 42 may thus be quickly and easily removed for washing as required.

The thickness 20 of the cushion 10 to either side of the central depression 26, is sufficient that it may be hollowed out to form one or more storage compartments 46 therein, for the storage of baby toys, diapers, wiping cloths, etc. Closure for the compartments 46 may be provided by a selectively openable flap 48 in the cover 38, which may be sealed by means of hook and loop fastener material (not shown) or other closure means as desired.

While the depth of the depression 26 is sufficient to preclude the rolling of an infant I to the sides of the depression 26, it is possible that an infant I could squirm downwardly toward the open end 28 of the depression, unless restrained in some manner. Thus, the cushion 10 may include a removable, washable infant restraint means, comprising a washable harness 52 removably securable to the cushion 10 within the depression 26, adjacent the open first end 28 thereof, by snaps 54 or other suitable temporary attachment means. The harness 52 is generally T-shaped and includes waist retention means, comprising opposite first and second waist straps 56 and 58 which form the cross-member of the T and secure together with mating portions of hook and loop fastening material 60, or other suitable means. The stem of the T shaped harness 52 comprises a soft and pliable crotch support 62, securable to the two ends of the waist straps 56 and 58 by further mating portions of hook and loop fastening material 60 or other suitable means. Thus, the straps 56/58 and crotch support 62 may be secured respectively about the waist or lower torso and crotch of the infant I, to ensure that the infant I does not slip from the depression 26.

Figure 2:
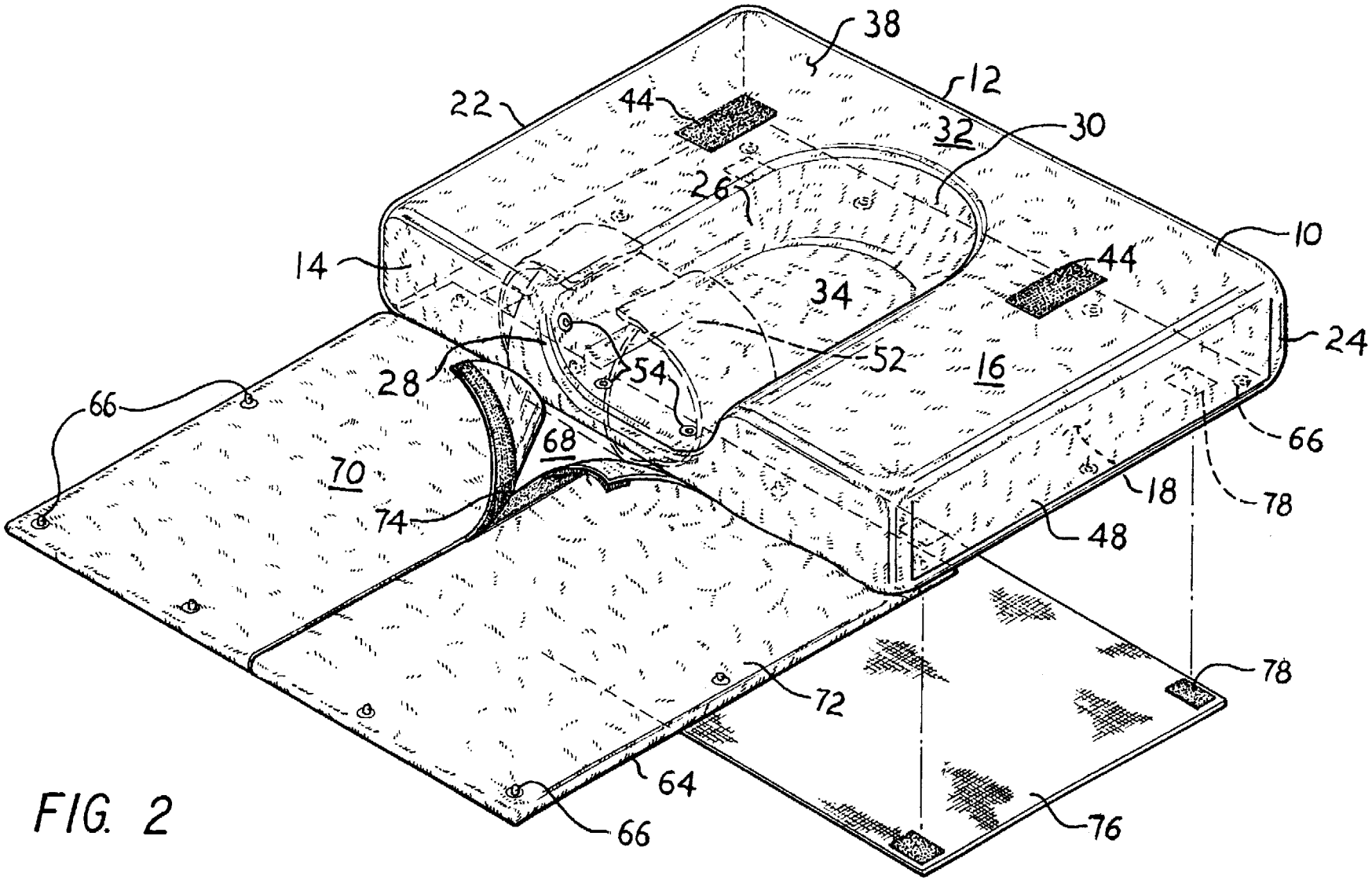
FIG. 2 is an exploded perspective view of an alternate embodiment of the present cushion, showing the removable attachment of a changing pad and a removable blanket therefor.

FIGS. 2 and 3 disclose further attachments for the cushion 10. One such attachment is a washable blanket 64, which is removably attachable to the bottom surface 18 of the cushion 10 adjacent the rearward edge 14 thereof. It is well known that infants, with their relatively small body mass per amount of skin surface area, tend to lose body heat more rapidly than adults. also, most infants are at times placed upon a soft surface (blanket, carpet, etc.) on the floor for play, and the present cushion 10 may also be placed directly upon the floor. As the floor of a residence or other structure is generally the coolest location in a room, it will be seen that some form of insulation is important to small infants. Many persons will wrap an infant in a conventional blanket, but the present removably attachable blanket 64 provides a much more convenient way of keeping the infant warm.

The blanket 64 is removably attachable to the cushion 10 (or to its cover 38, as in the other removably attachable articles described herein) by a plurality of snap fasteners 66 (or other suitable means) disposed about the periphery of the lower surface 18 of the cushion 10. Preferably, the blanket 64 includes a continuous lower sheet 68, with an upper sheet having first and second portions 70 and 72 which may be selectively secured together by means of mating hook and loop fastener portions 74 along common edges. The blanket 64 may be removed from its storage location beneath the cushion 10, and secured along the lower rear edge of the cushion 10 with the upper sheet portions 70/72 secured about the lower torso and legs of the infant I to keep the infant warm.

All parents will also appreciate the frequency with which small infants require the changing of diapers and the like. Accordingly, a washable changing pad 76 is removably secured to the underside 18 of the cushion 10 (or cover 38), by means of mating portions of hook and loop fastening material 78, or other suitable means (snap fasteners, etc.) as desired. The changing pad 76 may be stored beneath the cushion 10, between the blanket 64 and the lower surface 18 of the cushion 10, when not in use. When the changing pad is needed, the blanket 64 may be partially removed from the bottom 18 of the cushion 10 to access the changing pad 76, and the pad 76 removed from its temporary attachments beneath the cushion 10. The pad 76 thus provides sanitary protection for an underlying surface when the infant I requires changing, and may be returned to its location between the blanket 64 and the bottom 18 of the cushion 10 for storage when it is not needed.

In summary, the present infant support cushion 10 provides an excellent means of protecting a very young infant who is just beginning to develop muscular strength and motor skills. An infant placed within the depression of the present cushion is well protected in the event of a sudden drop or downward movement of the head, by the thick and resilient padding provided in the cushion immediately beneath the head of the infant. A removably attachable harness which is securable about the waist and torso, and about the crotch, of the infant provides further security for an infant placed within the depression of the cushion, by ensuring that the infant cannot slide or back out of the depression.

The thickness of the cushion also provides sufficient volume for one or more storage compartments to be formed therein, for the storage of various articles associated with the care of an infant (toys, spare diapers, bottles, baby wipes, etc.).

The entire cushion may be protected by means of a closely fitted, removable, and washable cover. The cover may include selectively openable and closable flaps or panels providing closure and access for the storage compartment(s) formed within the cushion.

Also, a blanket may be removably secured to the underside of the cushion (or cover), and removed and reattached to the rearward edge of the cushion adjacent the rearward or open end of the depression. The blanket may be closed completely about the lower torso and legs of an infant within the depression, in order to keep the infant from becoming chilled. A diaper changing pad may also be removably secured to the underside of the cushion, between the cushion (or cover) and the blanket when the blanket is store beneath the cushion. Each of the various accessories (cover, blanket, changing pad, and harness) may be removed and washed as required. The entire assembly may be packaged or stored in a storage bag or case when not needed, or for travel, etc., serving as a self contained and compact assemblage responding to several of the needs of a small infant.

It is to be understood that the present invention is not limited to the sole embodiments described above, but encompasses any and all embodiments within the scope of the following claims.

I claim:

1. An infant support cushion, comprising:

a resilient cushion having at least a forward edge, an opposite rearward edge, an upper surface, an opposite lower surface generally parallel to said upper surface defining a cushion depth therebetween, and a first end and opposite second end;

a generally semicylindrical infant torso cradling depression formed in said upper surface of said cushion and extending generally centrally across said cushion, said depression having an open first end and an opposite rounded and closed second end, with said open first end of said depression terminating at said rearward edge of said cushion and said closed second end of said depression terminating short of said forward edge of said cushion to define a head supporting and protecting portion of said cushion disposed between said forward end of said depression and said forward edge of said cushion, and;

a washable drool bib removably secured over said head supporting and cushioning portion of said cushion.

2. The infant support cushion according to claim 1, including:

a removable and washable form fitting cover for said cushion.

3. The infant support cushion according to claim 1, including:

a washable blanket removably securable to said cushion adjacent said rearward edge of said cushion and adapted to cover the legs and lower torso of an infant nestled within said depression of said cushion, with said blanket being removably attachable over said lower surface of said cushion for storage thereon.

4. The infant support cushion according to claim 3, wherein:

said blanket comprises a continuous lower sheet and an upper sheet having a first portion and a second portion separably securable together, to secure said blanket removably about the legs and lower torso of an infant nestled within said depression of said cushion.

5. The infant support cushion according to claim 1, including:

a washable changing pad removably securable to said lower surface of said cushion.

6. The infant support cushion according to claim 1, including:

washable infant restraint means removably securable to said cushion within said depression and adjacent said open first end thereof.

7. The infant support cushion according to claim 6, wherein:

said infant restraint means comprises opposite first and second waist straps removably securable to one another, and a third soft and pliable crotch support removably securable to said first and second waist straps to support an infant therein about the waist and lower torso and crotch.

8. The infant support cushion according to claim 1, including:

at least one storage compartment formed within at least one said end of said cushion.

9. The infant support cushion according to claim 8, including:

closure means for said at least one storage compartment.

10. The infant support cushion according to claim 1, wherein:

said resilient cushion portion has a generally rectangular parallelepiped configuration.

11. The infant support cushion according to claim 1, wherein:

said depression extends substantially greater than halfway through said cushion thickness.

12. The infant support cushion according to claim 1, wherein:

said cushion is formed of materials selected from the group of materials consisting of open cell foam plastic and closed cell foam plastic.

13. An infant support cushion, comprising:

a resilient cushion having a generally rectangular parallelepiped configuration and having at least a forward edge, an opposite rearward edge, an upper surface, an opposite lower surface generally parallel to said upper surface defining a cushion depth therebetween, and a first end and opposite second end;

a generally semicylindrical infant torso cradling depression formed in said upper surface of said cushion;

a washable drool bib removably securable to said cushion;

a removable and washable form fitting cover for said cushion;

at least one storage compartment formed within at least one said end of said cushion;

a washable blanket removably securable to said cushion adjacent said rearward edge of said cushion;

a washable changing pad removably securable to said lower surface of said cushion, and;

washable infant restraint means removably securable to said cushion within said depression.

14. The infant support cushion according to claim 13, wherein:

said blanket is adapted to cover the legs and lower torso of an infant nestled within said depression of said cushion, with said blanket being removably attachable over said lower surface of said cushion for storage thereon.

15. The infant support cushion according to claim 13, wherein:

said blanket comprises a continous lower sheet and an upper sheet having a first portion and a second portion separably securable together, to secure said blanket removably about the legs and lower torso of an infant nestled within said depression of said cushion.

16. The infant suppoer cushion according to claim 13, wherein:

said depression extends generally centrally across said cushion, said depression having an open first end and an opposire rounded and closed second end, with said open first end of said depression terminating at said rearward edge of said cushion and said closed second end of said depression terminating short of said forward edge of said cushion to define a head supporting and protecting portion of said cushion disposed between said forward end of said depression and said forward edge of said cushion.

17. The infant support cushion according to claim 13, wherein:

said infant restraint means comprises opposite first and second waist straps removably securable to one another, and a third soft and pliable crotch support removably securable to said first and second waist straps to support an infant therein about the waist and lower torso and crotch.

18. The infant support cushion according to claim 13, including:

closure means for said at least one storage compartment, comprising at least one selectively openable flap of material formed in said cover, with said at least one selectively openable flap of said cover being positioned over a corresponding said at least one storage compartment when said cover is installed over said cushion.

19. The infant support cushion according to claim 13, wherein:

said depression extends substantially greater than halfway through said cushion thickness.

20. The infant support cushion according to claim 13, wherein:

said cushion is formed of materials selected from the group consisting of open cell foam plastic and closed cell foam plastic.

* * * * *